United States Patent [19]

Heringer

[11] 4,103,472

[45] Aug. 1, 1978

[54] MANUAL TAPING DEVICE

[75] Inventor: Ronald Heringer, Pennsauken, N.J.

[73] Assignee: Natico, Inc., Chicago, Ill.

[21] Appl. No.: 851,209

[22] Filed: Nov. 14, 1977

[51] Int. Cl.[2] ..... B65B 61/00; B32B 31/00; B44C 7/00

[52] U.S. Cl. ..... 53/139.3; 156/391; 156/523; 156/577

[58] Field of Search ..... 156/391, 523, 577, 579; 53/139.3, 198 R

[56] References Cited

U.S. PATENT DOCUMENTS

| | | | |
|---|---|---|---|
| 2,057,060 | 10/1936 | Schantz | 156/391 |
| 2,057,061 | 10/1936 | Eggerss | 156/391 |
| 2,591,136 | 4/1952 | Cleary et al. | 156/391 |

*Primary Examiner*—Douglas J. Drummond
*Attorney, Agent, or Firm*—McDougall, Hersh & Scott

[57] ABSTRACT

A device for applying pressure sensitive adhesive tape for taping covers onto drums of large capacity including a tape dispensing post, a tensioning post, and a pressure roll, with means for guiding the device during hand actuation about the periphery of the covered drum with cutoff means for severing the tape.

14 Claims, 6 Drawing Figures

FIG.1
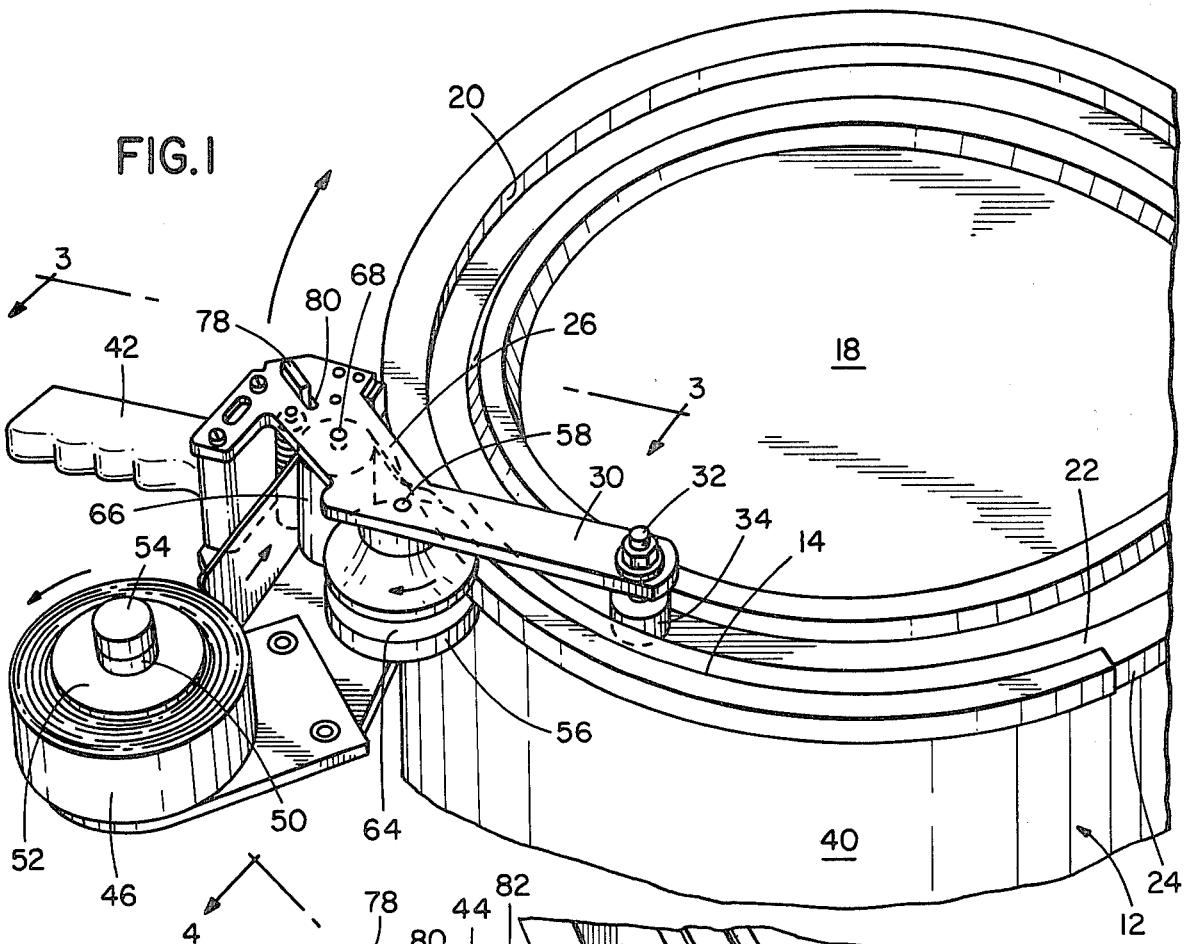
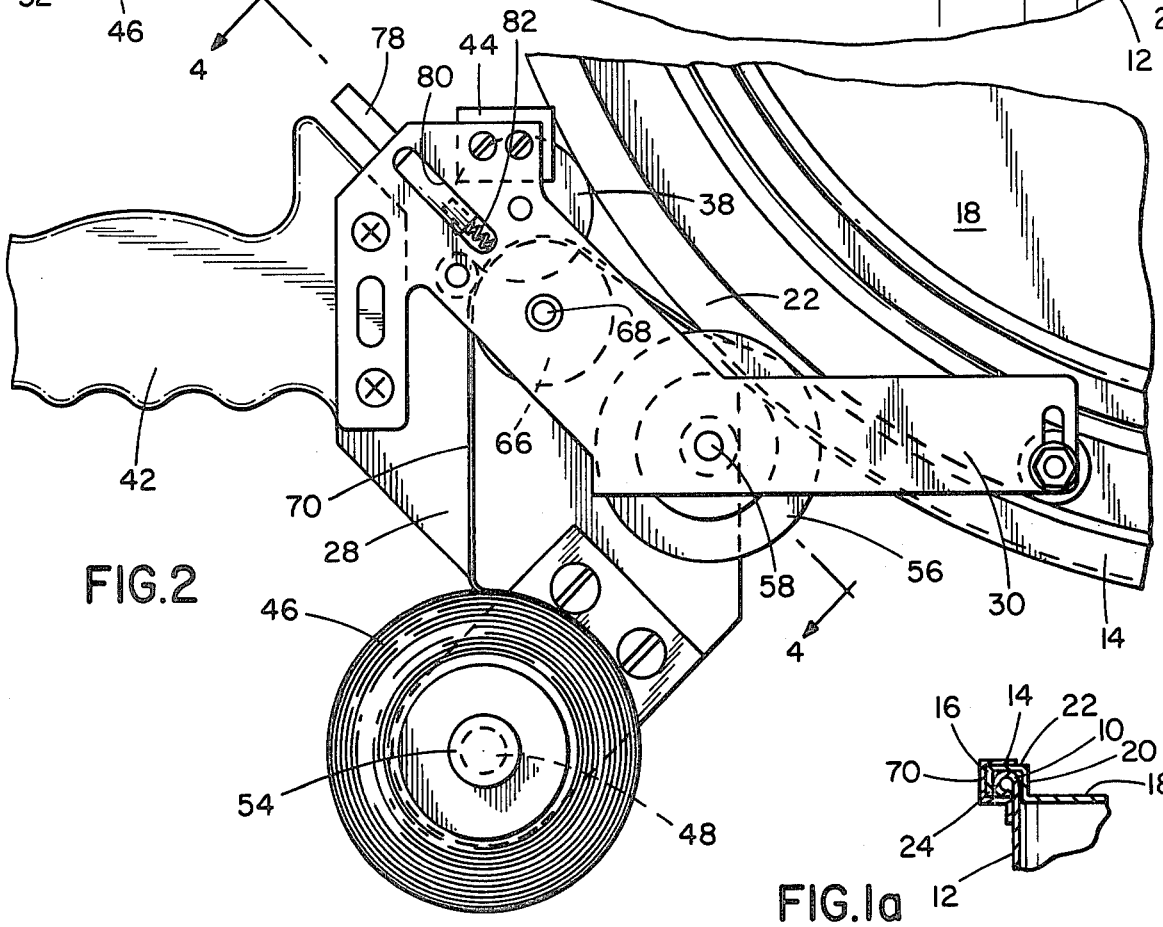
FIG.2
FIG.1a

MANUAL TAPING DEVICE

This invention relates to the taping of covers onto drums of large capacity to effect a sealing relation between the drum and the cover.

By the term "drums of large capacity" is meant drums having a capacity of 5, 10, 25 and ordinarily 55 to 60 gallons. Such drums may be formed of metal but more often are formed of fiberboard spirally wound to form a cylindrical shell to which a bottom wall is secured by a chime or other configuration. Drums of the type described are used for the storage and shipment of fluids and particulate materials, which, when of a chemical nature, the drums are usually lined on the interior with a film or coating of a plastic or other protective material that is resistant to the content material and which functions as a barrier to the transmission of vapors therefrom.

After the drums are filled, the open top end of the drum is adapted to be closed by a cover which may be formed of fiberboard or of a plastic material, with or without the underside provided with a suitable lining or coating as described above.

Generally, such covers are formed with an annular skirt which depends from a periphery resiliently to engage a flanged lip portion about the upper edge of the drum removably to secure the cover in position of use to enclose the open end of the drum. In addition, a metal band is positioned to embrace the peripheral edge portion after which the free ends are drawn circumferentially in the direction towards each other tightly to grip the cover in mounted relation on the drum. This operates firmly to secure the cover onto the drum and to enhance the sealing relation therebetween.

Such ring binders require considerable time for application and for removal. They are expensive and are easily damaged with the result that they are often limited to a single use. More importantly, they are incapable of providing a desired sealed engagement between the cover and drum.

Instead of making use of ring binders the art has sought to join the cover onto the drum by the use of binding tape. The binding tape is in the form of a flexible ribbon of plastic or coated fabric having pressure sensitive adhesive on one side. The tape is applied by hand to encircle the cover after it has been mounted in position of use on the drum. Even when great care is practiced in taping the cover onto the drum, it is difficult to maintain a steady position with the result that the amount of overlap varies from one portion of the drum to another. This detracts from the appearance and results in the formation of wrinkles which further detract from the appearance and the effectiveness of the joinder between the cover and the drum.

It is an object of this invention to provide a device which is capable of movement from drum to drum and which embodies means to enable hand taping of the cover onto the drum in a very rapid and efficient manner, without the need for skilled labor, and in which the tape is applied uniformly about the entire periphery of the drum to effect an attractive appearance as well as an effective seal between the cover and the drum, and which can be used with covered drums that differ in size or capacity without the need for modification or adjustment of the device.

These and other objects and advantages of this invention will hereinafter appear and, for purposes of illustration, an embodiment of the invention is shown in the accompanying drawing in which:

FIG. 1 is a perspective elevational view of the upper portion of a covered drum showing the taping device of this invention in position of use for taping the cover onto the drum;

FIG. 1*a* is a sectional view through the taped edge portion of the covered drum of FIG. 1;

FIG. 2 is a top plan view of the taping device shown in FIG. 1;

Figure 3:
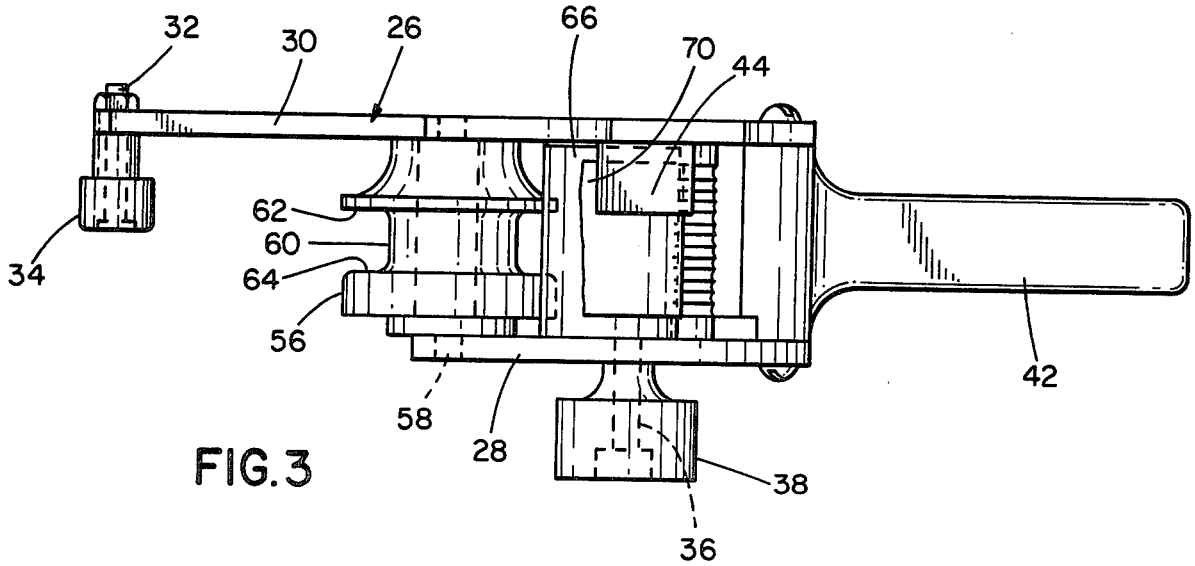
FIG. 3 is a view taken along the line 3—3 of FIG. 1.
Figure 4:
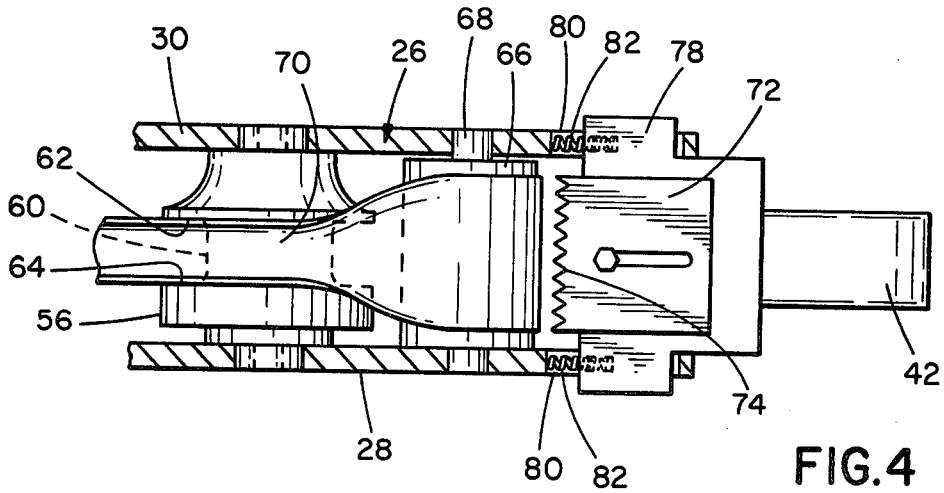
FIG. 4 is a sectional view taken along line 4—4 of FIG. 2.
Figure 5:
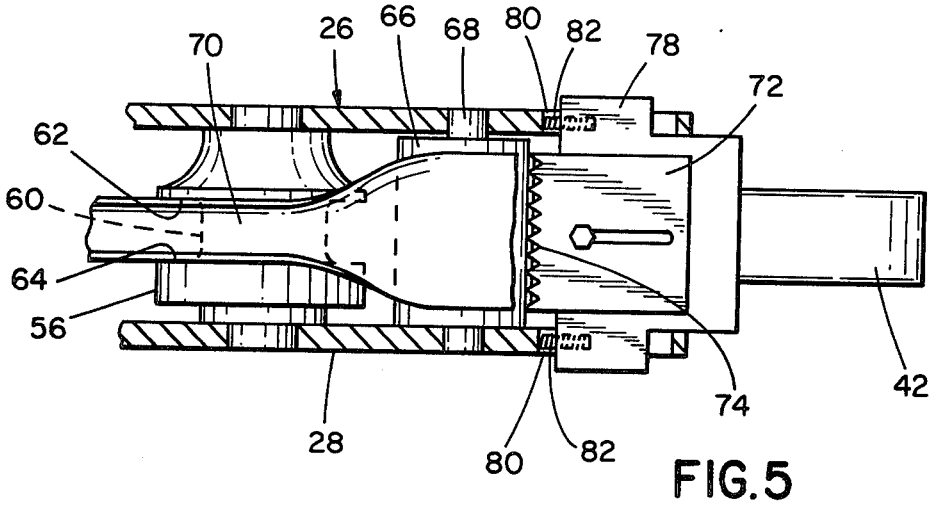
FIG. 5 is the same as FIG. 4, showing the cut-off in operative position.

Conventionally, drums of large capacity are formed with an annular lip 10 extending outwardly integrally from the upper open end of the drum 12. The cover, which is adapted to fit onto the open end of the drum, is formed with an annular groove 14 shaped to receive the lip 10 in seated relation therein. The grooved portion is formed by an annular rim 16 which rises from the outer periphery of the cover 18 and is defined by a vertically extending inner wall 20, and a top wall 22 which terminates in a skirt 24 that depends from the outer edge for a distance to embrace the lip 10.

The device of this invention comprises upper and lower rigid support members 26 and 28 respectively, joined one to the other in spaced parallel relation.

The upper support member 29 has a rearwardly and inwardly extending arm portion 30 from which a stub shaft 32 depends for mounting a roller 34 for free rotational movement at a level to engage the inner wall 20 of the rim, when the device is in position of use.

The lower support member 28 is provided with a stub shaft 36 which depends from a forward portion for mounting a roller 38 for free rotational movement at a level below the lip 10 so as to engage the side wall 40 of the drum immediately below the lip, when in position of use.

A handle 42 is secured at its rearward end portion between the forward end portions of the rigid supports 26 and 28 to extend angularly outwardly and forwardly of the support members so that the device will be guided by the roller 34 in engagement with the inner wall 20 of the rim and the roller 38 in engagement with the outer wall of the drum in response to manual force on the handle to roll the device about the periphery of the cover.

Secured to the bottom side of the upper support member 26, outwardly of the guide roll 34 and inwardly of the guide roll 38, but substantially in alignment therewith is a bearing block 44, preferably formed of a rigid plastic material which is slidable on a surface with little if any friction, such as of polyethylene, polytetrafluoroethylene and the like, positioned to ride on the top surface 22 of the rim when the device is in position of use. The block 44 serves as a guided support during actuation of the device about the periphery of the cover.

The roll of tape 46 is mounted for free rotational movement on a stub shaft 48 which extends upwardly from an outer and rearward portion of the lower support member 28 with spring means 50 between the washer 52 and the end of the nut member 54 for pressing the washer into engagement with the roll of tape mounted on the stub shaft to militate against uncontrolled unwinding of the tape. The level of the roll 46 can be adjusted, when desired, by the use of spacers or other means on the stub shaft between the removable nut member 54 and the support member 28.

A press roll 56 is mounted for free rotational movement on a spindle 58 that extends between the upper and lower support members 26 and 28, inwardly of the shaft support 48 for the roll of tape 46 and intermediate the guide rolls 34 and 38. The press roll 56 is formed with an annular groove 60 in its peripheral surface, in which the groove is dimensioned to have a width corresponding to the spaced relation between the top of the rim and the bottom of the skirt, or preferably the bottom of the lip 10 of the drum 12 when the cover is in position of use on the drum, with the groove 60 having a depth corresponding to the spaced relation between the outer periphery of the skirt and the drum so that the groove of the press roll will embrace the skirt and lip when the cover is in position of use on the drum, thereby to wrap the tape about the edge of the cover and the top of the drum when the latter is seated within the groove of the cover. The groove 60 is preferably formed with substantially straight spaced parallel side walls 62 and 64 to press the tape about the top side of the rim and the bottom side of the lip. The press roll can be formed of metal or plastic but it is preferred to form at least the tape engaging peripheral grooved portions of a resilient material such as a plastic or rubberlike material.

To tension the tape coming into engagement with the grooved portion of the press roll 56, there is provided a tensioning post or roller 66, mounted for free rotational movement on a spindle 68 extending between the spaced support members 26 and 28 to position the tensioning roller 66 outwardly and forwardly of the press roll 56 and inwardly and forwardly of the tape roll 46 so that the pressure-sensitive tape 70 passes about the tensioning roll 66 with the pressure-sensitive surface outermost during travel from the roll 46 to the press roll 56.

In use, the cover 18 is first placed on the drum with the lip 10 of the drum fully seated in the peripheral groove in the outer periphery of the cover. Then the device is placed onto the cover to locate the roller 34 inwardly of the wall 20 of the rim. The tape 70 is drawn from the roll and about the periphery of the tensioning roll 66 until an end portion of the tape can be adhered by hand onto the edge of the cover as by pressing the side with the pressure-sensitive adhesive onto the edge of the cover.

Thereafter, the handle is either pulled or pushed for displacement to roll the device about the cover. In response to such force, the device pivots about the roller 34 into engagement with the wall 20 of the rim to bring the roller 38 in engagement with the outer wall of the drum, with the block 44 at rest on the top surface 22 of the rim. The device is thus guided until it is rolled about the periphery of the cover with the press roll 56 embracing the edge of the cover.

As the device is rolled about the cover, with the leading portion of the tape 70 adhered to the edge of the cover, the tape will be drawn from the roll 46 for travel forwardly about the tensioning roll 66 and then rearwardly to between the press roll 56 and the adjacent edge of the cover, whereby the press roll will operate to wrap the tape about the edge of the covered drum and more or less smoothly arrange the tape under pressure about the skirt and lip to effect a sealing engagement therebetween.

Means are provided for cutoff of the tape 70 after completing encirclement of the tape about the periphery of the drum. For this purpose, a knife 72, in the form of a plate having serrated teeth 74 across the edge, is mounted for reciprocal movement radially into and out of engagement with the peripheral portion of the tensioning roll 66 over which the tape travels to sever the tape or to leave a line of weakness across which the tape can be separated. The cutting knife is supported for radial movement on a plate 76 which extends vertically between the upper and lower support members 26 and 28 to extend radially with the rearward edge in closely spaced relation with the periphery of the roller.

Means are provided constantly to urge the plate and knife towards retracted position away from the roller. In the illustrated modification, such means comprises lateral extensions 78 from the plate 76 which project through elongate slots 80 in the upper and lower support members, with compression springs 82 located in the slot between the extensions and the rearward edge of the slots constantly to urge the plate into the forward or retracted position. Thus when the taping operation has been completed, it is only necessary manually to displace the plate rearwardly to bring the cutting edge 74 of the knife 72 into engagement with the tape 70 to enable the tape to be separated. This leaves enough of the tape on the tensioning roll 66 to grasp and pull forward for adherence to the edge of the cover in preparation for the next cycle of operation.

It will be apparent that the position of the rolls on the various spindles and shafts can be adjusted to accommodate covered drums of different sizes, merely by the use of spacers and the like to space the rolls from the support members.

When the roll of tape is exhausted, it is only necessary to unscrew the nut member 54 threadably engaging the end of the shaft to replace the exhausted roll with a fresh roll of tape.

In operation, the tape is applied without wrinkling and in an attractive and uniform manner to secure the cover on the drum in sealing relation.

It will be understood that changes may be made in the materials of construction as well as the details of construction and operation without departing from the spirit of the invention, especially as defined in the following claims.

I claim:

1. A device for taping a cover onto a drum in which the cover has a peripheral rim and the drum has a peripheral lap adapted to be received in fitting relation within the rim when the cover is mounted onto the drum, said taping device comprising a rigid support plate, a first roller mounted for free rotational movement on a rearward portion of the support plate in position to engage the inner surface of the rim when the device is mounted in position of use, a second roller mounted for free rotational movement on a forward portion of the support plate at a level below the first roller and outwardly thereof to engage the outer surface of the drum below the lip when the device is in position of use, a pressure roller mounted for free rotational movement on the support plate between the first roller and the second roller at a level aligned with the rim for engaging the outer walls thereof when the device is in position of use, a tape supply roll mounted for free rotational movement on the support plate outwardly of the pressure roller, and a tension post fixed to the support plate forwardly of a line between the pressure roller and the tape supply roll for engagement by the tape during passage from the supply roll to the pressure roller, and a handle on the support plate.

2. A device as claimed in claim 1, which includes a slide block depending from the support plate inwardly of the second roller and outwardly of the first roller in position slideably to engage the top surface of the rim when the device is in position of use.

3. A device as claimed in claim 1, in which the tape supply roll is mounted for rotational movement at a level corresponding to the level of the pressure roller.

4. A device as claimed in claim 1, in which the handle extends forwardly from the support plate.

5. A device as claimed in claim 1, which includes means for vertical adjustment of the pressure roller for cross alignment with the rim of the cover.

6. A device as claimed in claim 1, in which the pressure roller is formed with a peripheral groove contoured to correspond with the contour of the outer portion of the rim of the cover.

7. A device as claimed in claim 6, in which the peripheral groove comprises a base portion bound by outwardly extending rim portions spaced one from the other by an amount corresponding to the height of the rim of the cover thereby to wrap the tape about the rim during movement of the device about the cover.

8. A device as claimed in claim 1 which includes means for severing the tape.

9. A device as claimed in claim 8, in which the means for severing the tape comprises a vertically disposed knife mounted for displacement in the direction toward and away from the tensioning post for engagement to engage the tape when displaced in the direction towards the tensioning post.

10. A device as claimed in claim 9 which includes means constantly urging the knife in the direction away from the tensioning post.

11. A device as claimed in claim 9 in which the knife is formed with a serrating edge for perforating the tape when displaced in the direction towards the tensioning post for engagement therewith.

12. A device as claimed in claim 9 which includes means for guiding the knife during displacement in the direction towards and away from the tensioning post.

13. A device as claimed in claim 1 in which the tensioning post is formed with a peripheral surface of a resilient material.

14. A device as claimed in claim 13 in which the tensioning post is formed with a corrugated surface.

* * * * *